US005352527A

United States Patent [19]

Harada et al.

[11] Patent Number: 5,352,527

[45] Date of Patent: Oct. 4, 1994

[54] THERMAL IMAGE TRANSFER RECORDING MEDIUM

[75] Inventors: Shigeyuki Harada, Mishima; Yoshihiko Hiyoshi; Takeshi Yuyama, both of Shizuoka; Keishi Taniguchi, Susono, all of Japan

[73] Assignee: Ricoh Company, Ltd., Tokyo, Japan

[21] Appl. No.: 946,609

[22] Filed: Sep. 18, 1992

[30] Foreign Application Priority Data

Sep. 19, 1991 [JP] Japan ..... 3-268413
Jan. 13, 1992 [JP] Japan ..... 4-024599

[51] Int. Cl.[5] ..... B41M 5/26

[52] U.S. Cl. ..... 428/423.1; 428/195; 428/204; 428/447; 428/488.4; 428/913; 428/914

[58] Field of Search ..... 428/336, 195, 341, 447, 428/480, 488.4, 913, 914, 195, 204, 423.1,

[56] References Cited

U.S. PATENT DOCUMENTS 4,806,422 2/1989 Ohno et al. ..... 428/336
4,910,087 3/1990 Torii et al. ..... 428/423.1

FOREIGN PATENT DOCUMENTS 2-145395 6/1990 Japan .

*Primary Examiner*—Patrick J. Ryan
*Assistant Examiner*—William A. Krynske
*Attorney, Agent, or Firm*—Oblon, Spivak, McClelland, Maier & Neustadt

[57] ABSTRACT

A thermal image transfer recording medium, containing a support, a thermal image transfer ink layer formed on the support, and a heat-resistant protective layer formed on the back side of the support, opposite to the thermal image transfer ink layer with respect to the support, the heat-resistant protective layer having a tensile strength effective to prevent the protective layer from adhering to a thermal head and to prevent loss of flexibility of the protective layer, the heat-resistant protective layer, containing an amount of each of (i) an amino-modified polysiloxane, (ii) a polyisocyanate and (iii) a reaction product of the amino-modified polysiloxane and the polyisocyanate effective for obtaining the tensile strength in the heat-resistant protective layer.

31 Claims, No Drawings

THERMAL IMAGE TRANSFER RECORDING MEDIUM

BACKGROUND OF THE INVENTION

1. Field of the Invention

The present invention relates to a thermal image transfer recording medium comprising a support, a thermal image transfer ink layer (hereinafter referred to as an ink layer) formed thereon, and a heat resistant protective layer at the back side of the support, opposite to the ink layer.

2. Discussion of Background

Conventionally, a thermal image transfer recording medium comprising a support and an ink layer on one side of the support is employed in the case where output images of the computer and word processor are printed in accordance with the thermal image transfer recording method.

Am a support for use in the above-mentioned thermal image transfer recording medium, in general, a sheet of condenser paper and paraffin paper with a thickness of 10 to 20 μm, or a film of polyester and cellophane with a thickness of 3 to 20 μm are employed. The thermally transferable ink composition which is prepared by mixing wax and a coloring agent such as a pigment or dye is coated on the above-mentioned support. Thus, the thermal image transfer recording medium is obtained.

For example, when a polyethylene terephthalate film is employed as a support in the above-mentioned thermal image transfer recording medium, a portion of the support is melted by a thermal head and sometimes adhered to a thermal head in the recording process. This results in a sticking problem.

This sticking phenomenon causes a considerable decrease of image quality. In addition, the melted portion of the support sticks to the thermal head, which makes it impossible to transport the thermal image transfer recording medium.

In order to prevent the above-mentioned sticking phenomenon, there are many proposals to provide a heat-resistant protective layer on either side of the support in a thermal image transfer recording medium. For example, heat-resistant protective layers comprising a silicone resin, epoxy resin, melamine resin, phenolic resin, fluorine-containing resin, polyimide resin, polyamide resin or cellulose resin are disclosed in Japanese Laid-Open Patent Applications 55-7467 and 63-172688. Moreover, as in Japanese Laid-Open Patent Application 60-201989. a heat-resistant protective layer comprising aromatic polyamide is provided.

The above-mentioned heat-resistant protective layers show a large dynamic friction when coming in contact with a thermal head, whereby transportation failure of the thermal image transfer recording medium occurs and the thermal head is worn out by the repeated image transfer recording operations over an extended period of time.

There is proposed a method of preparing a thermal image transfer recording medium in which a silicone oil is contained in a heat-resistant protective layer comprising a highly heat-resistant resin. In accordance with this method, the silicone oil in the protective layer migrates to the surface of the heat-resistant protective layer and the obtained ink image is stained with the silicone oil, so that the image quality is decreased. As a countermeasure for the above-mentioned problem, Japanese Laid-Open Patent Applications 61-184717 and 62-220385 disclose a thermal image transfer recording medium comprising a back layer (heat-resistant protective layer) comprising a silicone-modified polyurethane resin.

The silicone-modified polyurethane resin has a excellent lubricating properties, but it is readily softened or melted under application of heat thereto by a thermal head, so that the support is cracked when the image transfer is carried out with comparatively high heat energy applied thereto. Furthermore, when this kind of recording medium is stored at an ambient temperature of 50° C. or more, the components in the ink layer migrate to the back layer in contact with the aforementioned ink layer because of weak releasing properties of the silicone-modified polyurethane resin. As a result, the blocking phenomenon takes place.

In Japanese Laid-Open Patent Application 61-143195, there is another proposal of a thermal image transfer recording medium comprising a back layer which comprises a silicone graft acrylic copolymer or silicone block acrylic copolymer. Such a back layer has lubricating properties sufficient for preventing the sticking phenomenon, and has satisfactory heat-resistance and blocking resistance. However, the above image transfer recording medium has the shortcomings that the back layer is scraped by a thermal head since film-forming properties of the above-mentioned copolymer are poor. As a result, white colored materials are adhered to the thermal head, and the obtained image quality is lowered.

As mentioned above, a variety of thermal image transfer recording media comprising a heat-resistant protective layer are proposed, bun the conventional image transfer recording media are not practical when the thermal image transfer is carried out with a large quality of thermal energy applied thereto over a long period of time. This is because transportation failure is caused, the thermal head is worn out and the support is cracked which lowers the image quality. In addition, the blocking resistance of those conventional recording media is insufficient and the problem of dust adhesion to a thermal head is not solved.

SUMMARY OF THE INVENTION

It is therefore a first object of the present invention to provide a thermal image transfer recording medium free from the above-mentioned conventional shortcomings, capable of producing images with excellent quality, with the support not creased or cracked even when the image transfer is carried out with the application of a large amount of energy thereto, and multiple-use thermal image transfer recording or high-speed image transfer is performed.

A second object of the present invention is to provide a thermal image transfer recording medium with improved blocking resistance, which medium does not produce the problem of dust adhesion to the thermal head.

The above objects of the present invention can be achieved by a thermal image transfer recording medium comprising a support, an ink layer formed on the support, and a heat-resistant protective layer formed on the back side of the support, opposite to the ink layer, which heat-resistant protective layer comprises amine-modified polysiloxane, polyisocyanate and a reaction product of the amino-modified polysiloxane and the polyisocyanate.

The objects of the present invention can also be achieved by a thermal image transfer recording medium comprising a support, an ink layer formed on the support and a heat-resistant protective layer formed on the back side the support, opposite to the ink layer, which heat-resistant protective layer comprises amino-modified polysiloxane, polyisocyanate and a reaction product of aromatic diamine and polyisocyanate.

Furthermore, the objects of the present invention can be achieved by a thermal image transfer recording medium comprising a support, an ink layer formed on the support and a heat-resistant protective layer formed on the back side of the support, opposite to the ink layer, which heat-resistant protective layer comprises alcohol-modified polysiloxane, polyisocyanate and a reaction product of the alcohol-modified polysiloxane and the polyisocyanate.

DETAILED DESCRIPTION OF THE PREFERRED EMBODIMENT

A first image transfer recording medium according to the present invention comprises a support and an ink layer formed on the support, and a heat-resistant protective layer on the back side of the support comprising amino-modified polysiloxane and polyisocyanate and a reaction product of the amino-modified polysiloxane and the polyisocyanate.

The amino-modified polysiloxane for use in the present invention contains at least one amino group at the end of a siloxane segment or in a side chain thereof. Examples of the amino-modified polysiloxane include the following compounds Nos. 1 to 7:

No. 1

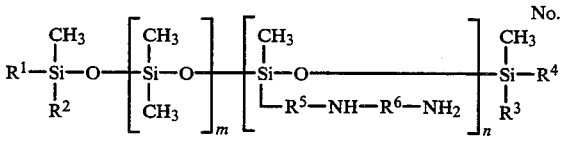

wherein $R^1$, $R^2$, $R^3$, and $R^4$ each represent a methyl group or a methoxy group, $R^5$ and $R^6$ each represent an alkylene group having 1 to 10 carbon atoms, and m and n each represent an integer of 1 to 20;

No. 2

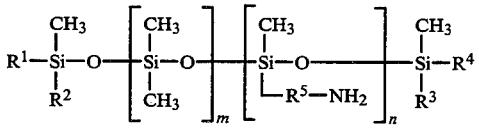

wherein, $R^1$, $R^2$, $R^3$, and $R^4$ each represent a methyl group or an methoxy group, $R^5$ represents an alkylene group having 1 to 10 carbon atoms, and m and n each represent an integer of 1 to 20;

No. 3

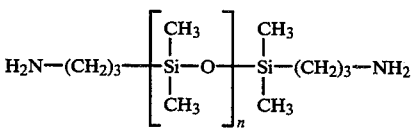

wherein n represents an integer of 1 to 300;

No. 4

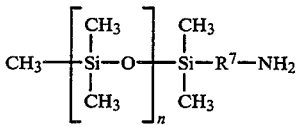

wherein $R^7$ represents an alkylene group having 1 to 10 carbon atoms, and n represents an integer of 1 to 300;

No. 5

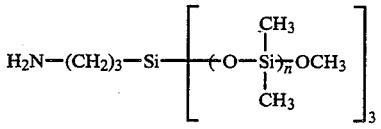

wherein n represents an integer of 2 to 20;

No. 6

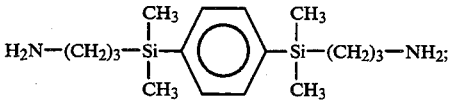

and

No. 7

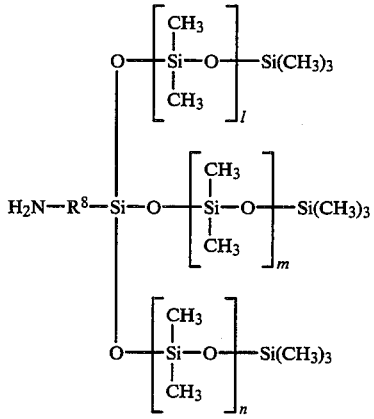

wherein $R^8$ represents an alkylene group having 1 to 10 carbon atoms, and l, m and n each represent an integer of 1 to 300. The polyisocyanate for use in the protective layer is an aliphatic compound having at least two isocyanate groups or an aromatic compound having at least two isocyanate groups.

Specific examples of the polyisocyanate for use in the present invention are am follows: toluene-2,4-diisocyanate, toluene-2,6-diisocyanate, 4-methoxy-2,4-diisocyanate, 4-isopropyl-1,3-phenylenediisocyanate, 4-chloro-1,3-phenylenediisocyanate, 4-butoxy-1,3-phenylenediisocyanate, 2,4-diisocyanate-diphenylether, 4,4-methylenebis(phenylisocyanate), 1,5-naphthalene diisocyanate, benzidine isocyanate, o-nitrobenzidine diisocyanato, 4,4-diisocyanate benzyl, m-phenylene diisocyanate, p-phenylene diisocyanate, 1,3-xylene diisocyanate and 1,4-xylene diisocyanate.

Furthermore, addition products of the above-mentioned polyisocyanate and other compounds can also be employed in the present invention. Examples of the above-mentioned addition product include the following compounds Nos. 8 to 14:

No. 8

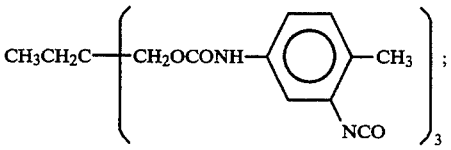

No. 9

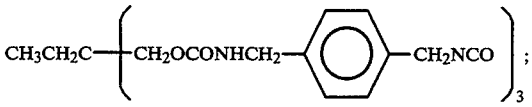

No. 10

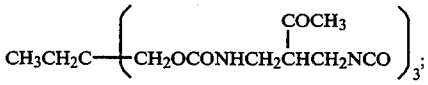

No. 11

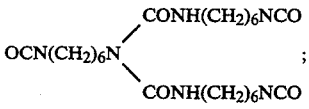

No. 12

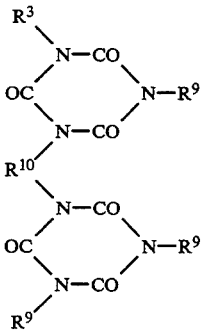

wherein $R^9$ represents

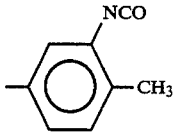

and $R^{10}$ represents group;

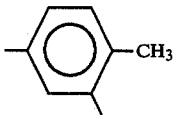

No. 13

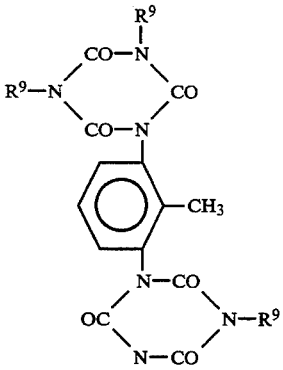

wherein $R^9$ represents

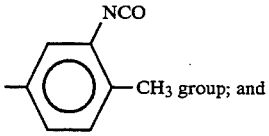

No. 14

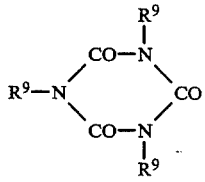

wherein $R^9$ represents

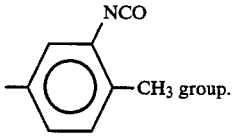

To obtain the reaction product, the previously mentioned amino-modified polysiloxane is allowed to react with the previously mentioned polyisocyanate in such a manner that the functional group ratio of the isocyanate group in the polyisocyanate to the amino group in the amino-modified polysiloxane is set to 1 or more, more preferably 1 or 2 in one molecule. Namely, the amino-modified polysiloxane is added to the reaction system in amounts equimolar with the polyisocyanate or in excess. This reaction is carried out in an organic solvent in the presence or absence of a catalyst at 0° to 150° C., more preferably at 20° to 80° C., over a period of 10 minutes to 10 hours.

The reaction product of amino-modified polysiloxane and polyisocyanate having a tensile strength of 100 to 700 kg/cm$^2$, more preferably 150 to 300 kg/cm$^2$, and a breaking extension of 50% or more, more preferably 250 to 800% when formed in a cast film is preferred in the present invention.

It is preferable that this type of heat-resistant protective layer have a tensile strength in the range of 100 to 700 kg/cm$^2$, more preferably in the range of 150 to 300 kg/cm$^2$.

In the case where the tensile strength of the heat-resistant protective layer is within the above range, the heat-resistant protective layer in the thermal image transfer recording medium is not easily impaired by the dynamic friction at a contact point with the thermal head, and the components of the protective layer in the form of particles can be prevented from adhering to the thermal head, or the sticking of the fused components of the protective layer to the thermal head can be avoided. Consequently, the image quality obtained by use of such an image transfer recording medium does not tend to lower. In addition, the transport performance of the thermal image transfer recording medium in a thermal transfer printer is not lowered because the flexibility of the heat-resistant protective layer does not deteriorate.

Furthermore, it is preferable that the heat-resistant protective layer have a breaking extension of 50% or more, more preferably in the range of 250 to 800%.

When the breaking extension of the heat-resistant protective layer is 50% or more, the heat-resistant protective layer is not easily impaired by the dynamic friction at a contact point with the thermal head.

The above-mentioned tensile strength and breaking extension of the heat-resistant protective layer can be obtained by appropriately selecting the combination of the amino-modified polysiloxane, the polyisocyanate, and the reaction product of the amino-modified polysiloxane and polyisocyanate, and adjusting the mixing ratio thereof.

A second thermal image transfer recording medium of the present invention comprises a support, an ink layer formed thereon, and a heat-resistant protective layer formed on the back side of the support, opposite to the ink layer with respect to the support, which protective layer, comprising the amino-modified polysiloxane and the polyisocyanate and a reaction product of aromatic diamine and the polyisocyanate.

In this case, the same examples of the amino-modified polysiloxane and the polyisocyanate as previously mentioned can be employed.

Furthermore, to prepare the reaction product of the aromatic diamine and the polyisocyanate, the following compounds are preferably used as the aromatic diamine:

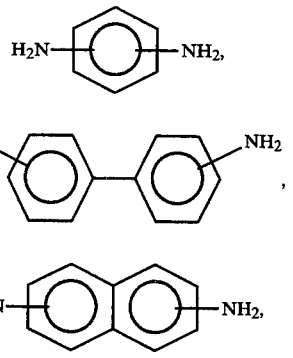

-continued

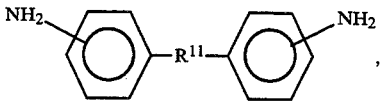

wherein $R^{11}$ represents

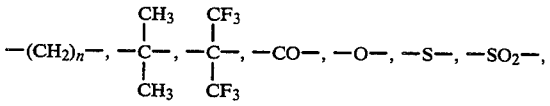

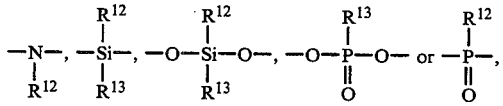

in which $R^{12}$ and $R^{13}$ each represent an aryl group having 1 to 30 carbon atoms or an alkyl group having 1 to 30 carbon atoms, and n represents an integer of 1 to 3;

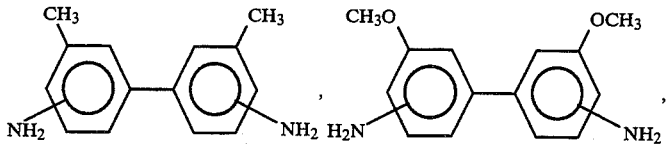

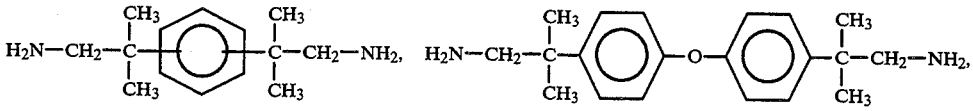

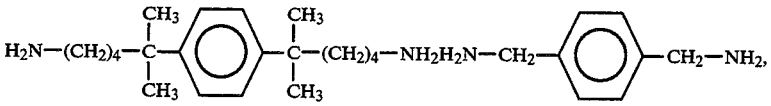

and

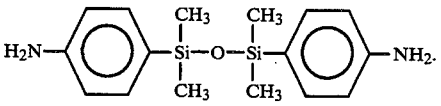

To prepare a reaction product of the aromatic diamine and the polyisocyanate, the aromatic diamine may be allowed to react with the polyisocyanate in accordance with the conventional method of a polyaddition reaction.

The reaction product of aromatic diamine and the polyisocyanate having a tensile strength of 100 to 700 kg/cm$^2$, more preferably 150 to 300 kg/m$^2$, and a breaking extension of 50% or more, more preferably 250 to 800% when formed in a cast film is preferred in the present invention.

It is preferable that this type of heat-resistant protective layer have a tensile strength in the range of 100 to 700 kg/cm$^2$, more preferably in the range of 150 to 300 kg/cm$^2$.

In the case where the tensile strength of the heat-resistant protective layer is within the above range, the heat-resistant protective layer in the thermal image transfer recording medium is not easily impaired by the dynamic friction at a contact point with the thermal head, and the components of the protective layer in the form of particles can be prevented from adhering to the thermal head, or the sticking of the fused components of the protective layer to the thermal head can be avoided. Consequently, the image quality obtained by use of such an image transfer recording medium does not tend to lower. In addition, the transport performance of the thermal image transfer recording medium in a thermal transfer printer is not lowered because the flexibility of the heat-resistant protective layer does not deteriorate.

Furthermore, it is preferable that the heat-resistant protective layer have a breaking extension of 50% or more, more preferably in the range of 200 to 800%.

When the breaking extension of the heat-resistant protective layer is 50% or more, the heat-resistant protective layer is not easily impaired by the dynamic friction at a contact point with the thermal head.

The above-mentioned tensile strength and breaking extension of the heat-resistant protective layer can be obtained by appropriately selecting the combination of the amino-modified polysiloxane, the polyisocyanate and the reaction product of the aromatic diamine and polyisocyanate, and adjusting the mixing ratio thereof.

A third thermal image transfer recording medium according to the present invention comprises a support, an ink layer formed thereon, and a heat-resistant protective layer formed on the back side of the support, opposite to the ink layer with respect to the support, which protective layer comprises alcohol-modified polysiloxane, the polyisocyanate, and a reaction product of the alcohol-modified polysiloxane and the polyisocyanate.

The alcohol-modified polysiloxane contained in the above-mentioned protective layer has an alcohol hydroxyl group at the end of a siloxane segment or in a side chain thereof. Preferable examples of the alcohol-modified polysiloxane include the following compounds Nos. 15 to 17:

No. 15

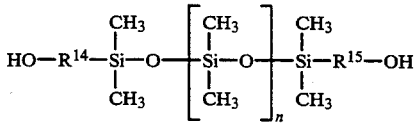

wherein $R^{14}$ and $R^{15}$ each represent an alkylene group having 1 to 10 carbon atoms, and n represents an integer of 1 to 300;

No. 16

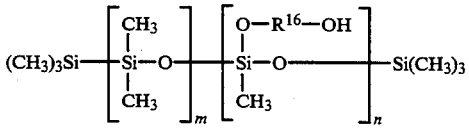

wherein $R^{16}$ represents an alkylene group having 1 to 10 carbon atoms, and m and n each represent an integer of 1 to 20 ;

No. 17

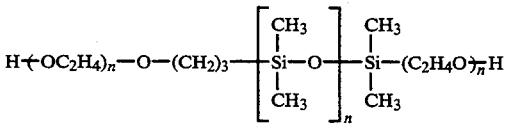

wherein n represents an integer of 0 to 300;

No. 18

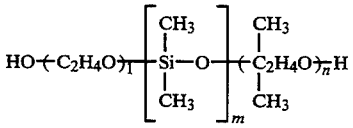

wherein 1 represents an integer of 1 to 20, m represents an integer of 5 to 300, and n represents an integer of 1 to 10; and No. 19

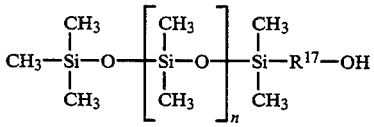

wherein $R^{17}$ represents an alkylene group having 1 to 10 carbon atoms, and n represents an integer of 1 to 300.

In this case, the same examples of the polyisocyanate as previously mentioned can be employed.

To obtain the reaction product, the previously mentioned alcohol-modified polysiloxane is allowed to react with the previously mentioned polyisocyanate in such a manner that the functional group ratio of the isocyanate group in the polyisocyanate to the alcohol hydroxyl group in the alcohol-modified polysiloxane is set to 1 or more, more preferably 1 or 2, in one molecule. Namely, the alcohol-modified polysiloxane is added to the reaction system in amounts equimolar with the polyisocyanate or in excess. This reaction is carried cut in an organic solvent in the presence or absence of a catalyst at 0° to 150° C., more preferably at 20° to 80° C., over a period of 10 minutes to 10 hours.

The reaction product of the amine-modified polysiloxane and polyisocyanate having a tensile strength of 100 to 700 kg/cm$^2$, more preferably 150 to 300 kg/cm$^2$, and a breaking extension of 50% or more, more preferably 250 to 800% when formed in a cast film is preferred in the present invention.

It is preferable that this type of heat-resistant protective layer have a tensile strength in the range of 100 to 700 kg/cm$^2$, more preferably in the range of 150 to 300 kg/cm$^2$.

In the case where the tensile strength of the heat-resistant protective layer is within the above range, the heat-resistant protective layer in the thermal image transfer recording medium is not easily impaired by the dynamic friction at a contact point with the thermal head, and the components of the protective layer in the form of particles can be prevented from adhering to the thermal head, or the sticking of the fused components of the protective layer to the thermal head can be avoided. Consequently, the image quality obtained by use of such an image transfer recording medium does not tend to lower. In addition, the transport performance of the thermal image transfer recording medium in a thermal transfer printer is not lowered because the flexibility of the heat-resistant protective layer does not deteriorate.

Furthermore, it is preferable that the heat-resistant protective layer have a breaking extension of 50% or more, more preferably in the range of 250 to 800%.

The above-mentioned tensile strength and breaking extension of the heat-resistant protective layer can be obtained by appropriately selecting the combination of the alcohol-modified polysiloxane, the polyisocyanate and the reaction product of the alcohol-modified polysiloxane and polyisocyanate, and adjusting the mixing ratio thereof.

It is preferable that the protective layer of the thermal image transfer recording of the present invention have a thickness of 0.1 to 3.0 μm, more preferably in the range of 0.4 to 1.2 μm.

As a material for the support, the conventional materials, for example, a film of polyethylene, polypropylene, polystyrene, polyvinyl chloride, polyvinylidene chloride, nylon, polycarbonate, or polyethylene terephthalate can be employed.

In the thermal image transfer recording medium of the present invention, any of the conventionally known thermal transfer ink layers comprising a coloring agent, a wax, a resin, and a lubricant can be employed.

Specific examples of the coloring agent include pigments and dyes such as carbon black, red iron oxide, Lake Red C, Fast Sky Blue, Benzidine Yellow, Phthalocyanine Green, Phthalocyanine Blue, direct dye, oiliness dye, and basic dye.

Examples of the wax are carnauba wax, montan wax, ozocerite, microcrystalline wax, rice wax, cersine wax, paraffine wax, polyethylene wax, and caster hardended oil.

Examples of the resin are acrylic resin, methacrylic resin, styrene resin, vinyl acetate resin, vinyl chloride resin, vinylidene chloride resin, polyester resin, polyether resin, polyacetal resin, epoxy resin, terpene resin, and rosin resin.

Examples of the lubricant are metallic soaps such as lithium stearate, magnesium stearate, calcium stearate, strontium stearate, barium stearate, calcium laurate, barium laurate, lithium 12-hydroxystearate, calcium 12-hydroxystearate, and lead dibasic stearate; N,N-substituted fatty acid amides such as N,N'-ethylenebis-12-hydroxystearic acid amide, N,N'-ethylenebis lauric acid amide, N,N'-methylenebis stearic acid amide, N,N'-ethylenebis stearic acid amide, N,N'-hexamethylenebis oleic acid amide, N,N'-distearyl adipic acid amide, and N,N'-distearylterephthalic acid amide; polytetrafluoroethylene, and silicone resin.

In the present invention, an overcoat layer may be formed on the ink layer. The provision of the overcoat layer eliminates the thermal transfer failure which may be caused depending on the lubricating properties of the employed transfer sheet, and improves the adhesion of the ink layer of the recording medium to the transfer sheet. The overcoat layer for use in the present invention comprises a wax and a resin, and may comprise a pigment when necessary. The same waxes and resins as used in the above-mentioned ink layer can be used in the overcoat layer.

The feature of this invention will become apparent in the course of the following description of exemplary embodiments, which are given for illustration of the invention and are not intended to be limiting thereof.

EXAMPLE 1

Formation of Heat-resistant Protective Layer 150 parts by weight of amino-modified polysiloxane (Compound No. 3) with a number average molecular weight of about 1400, represented by the following formula (I), were added to 100 parts by weight of dimethyl acetoamide to obtain a mixture.

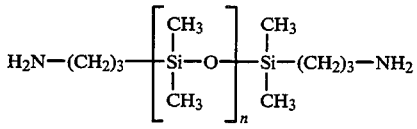

(I)

To the thus obtained mixture, a solution obtained by dissolving 35 parts by weight of hydrogenated 4,4'-methylene-bis(phenyl isocyanate) in 100 parts by weight of methyl ethyl ketone was added dropwise over a period of 15 minutes with stirring in a stream of nitrogen at 0° C.

After the completion of the addition, the above obtained mixture was stirred at 0° C. for 30 minutes. With the temperature of the mixture gradually increased, the mixture was further stirred at 50° C. for 6 hours to obtain a reaction product. The intrinsic viscosity of the above reaction product was 0.65 dL/g. The cast film obtained from the reaction product in the solvent had a tensile strength of 220 kg/cm$^2$, and breaking extension of 140%.

Thereafter, 10 parts by weight of the reaction product, 0.2 parts by weight of the amino-modified polysiloxane of formula (I), and 4 parts by weight of polyisocyanate (Compound No. 8) represented by the following formula (II) were dissolved in 260 parts by weight of methyl ethyl ketone to prepare a heat-resistant protective layer coating liquid.

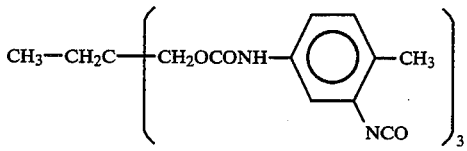

(II)

The heat-resistant protective layer coating liquid was coated on one side of a PET film with a thickness of 4.5 μm, serving as a support, and dried at 105° C. for 10 sec, so that a heat-resistant protective layer with a thickness of 0.6 μm was formed on the support.

Formation of Ink Layer 80 parts by weight of an emulsion of methyl methacrylate—acrylonitrile—butyl methacrylate copolymer with a solid content of 50% and 20 parts by weight of a carbon black dispersion containing 20 wt. % of carbon black therein were mixed to prepare an ink layer coating liquid.

The thus obtained ink layer coating liquid was coated on the other side of the support, that is, opposite to the protective layer with respect to the support, and dried, so that an ink layer with a thickness of 4 μm was formed on the support.

Thus, a thermal image transfer recording medium No. 1 according to the present invention was obtained.

EXAMPLE 2

Formation of Heat-resistant Protective Layer 150 parts by weight of amino-modified polysiloxane of the formula (I) were added to 100 parts by weight of dimethyl acetoamide to obtain a mixture.

To the thus obtained mixture, a solution obtained by dissolving 45 parts by weight of polyisocyanate (Compound No. 9) represented by the following formula (III)

in 100 parts by weight of methyl ethyl ketone was added dropwise over a period of 15 minutes with stirring in a stream of nitrogen at 0° C.

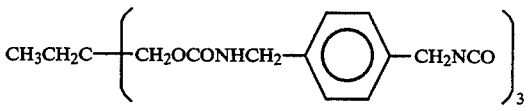

(III)

After the completion of the addition, the above obtained mixture was stirred at 0° C. for 30 minutes. with the temperature of the mixture gradually increased, the mixture was further stirred at 50° C. for 12 hours to obtain a reaction product. The intrinsic viscosity of the above reaction product was 0.70 dL/g. The cast film obtained from the reaction product in the solvent had a tensile strength of 140 kg/cm$^2$, and a breaking extension of 300%.

Thereafter, 10 parts by weight of the reaction product, 0.2 parts by weight of amino-modified polysiloxane with a number average molecular weight of about 4700 represented by following formula (IV) and, 10 parts by weight of polyisocyanate of the formula (III) are dissolved in 300 parts of methyl ethyl ketone to prepare a heat-resistant protective layer coating liquid.

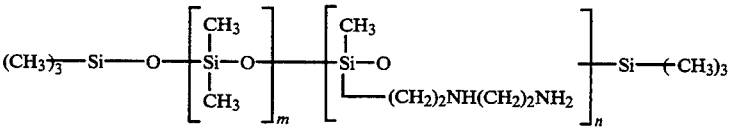

(IV)

The heat-resistant protective layer coating liquid was coated on one back side of a PET film with a thickness of 4.5 μm serving as a support, and dried at 105° C. for 10 sec, so that a heat-resistant protective layer with a thickness of 0.6 μm was formed on the back side of the support.

Formation of Ink Layer 80 parts by weight of an emulsion of methyl methacrylate—acrylonitrile—methyl acrylate copolymer with a solid content of 50% and 20 parts by weight of a carbon black dispersion containing 20 wt. % of carbon black therein were mixed to prepare an ink layer coating liquid.

The thus obtained ink layer coating liquid was coated on the other side of support, that is, opposite to the protective layer with respect to the support, and dried, so that an ink layer with a thickness of 5 μm was formed on the support.

Thus, a thermal image transfer recording medium No. 2 according to the present invention was obtained.

EXAMPLE 3

Formation of Heat-resistant Protective Layer 150 parts by weight of amino-modified polysiloxane of the formula (I) were added to 100 parts by weight of dimethyl acetoamide to obtain a mixture.

To the thus obtained mixture, a solution obtained by dissolving 38 parts by weight of polyisocyanate (Compound No. 11) represented by the following formula (V) in 100 parts by weight of methyl ethyl ketone was added dropwise over a period of 15 minutes with stirring in a stream of nitrogen at 0° C.

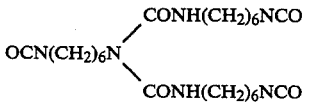

(V)

After the completion of the addition, the above obtained mixture was stirred at 0° C. for 30 minutes. With the temperature of the mixture gradually increased, the mixture was further stirred at 50° C. for 12 hours to obtain a reaction product. The intrinsic viscosity of the above reaction product was 0.72 dL/g. The cast film obtained from the reaction product in the solvent had a tensile strength of 200 kg/cm$^2$, and a breaking extension of 250%.

Thereafter, 10 parts by weight of the reaction product, 5 parts by weight of polyisocyanate of formula (V), and 0.15 parts of amine-modified polysiloxane of formula (I) were dissolved in 260 parts by weight of methyl ethyl ketone to prepare a heat-resistant protective layer coating liquid.

The heat-resistant protective layer coating liquid was coated on one side of a PET film with a thickness of 4.5 μm, serving as a support and dried at 105° C. for 10 sec, so that a heat-resistant protective layer with a thickness 0.6 μm was formed on the support.

Formation of Ink Layer 80 parts by weight of an emulsion of methyl methacrylate—acrylonitrile—methyl acrylate copolymer with a solid content of 50% and 20 parts by weight of a carbon black dispersion containing 20 wt. % of carbon black therein were mixed to prepare an ink layer coating liquid.

The thus obtained ink layer coating liquid was coated on the other side of the support, that is, opposite to the protective layer with respect to the support, and dried, so that an ink layer with a thickness of 5 μm was formed on the support.

Thus, a thermal image transfer recording medium No. 3 according to the present invention was obtained.

EXAMPLE 4

Formation of Heat-resistant Protective Layer 150 parts by weight of amine-modified polysiloxane of formula (i) were added to 100 parts by weight of dimethyl acetoamide to obtain a mixture.

To the thus obtained mixture, a solution obtained by dissolving 35 parts by weight of hydrogenated 4,4'-methylene-bis(phenyl isocyanate) in 100 parts by weight of methyl ethyl ketone was added dropwise over a period of 30 minutes with stirring in a stream of nitrogen an 0° C.

After the completion of the addition, the above obtained mixture was stirred at 0° C. for 30 minutes. With the temperature of the mixture gradually increased, the mixture was further stirred at 50° C. for 6 hours to obtain a reaction product. The above reaction product had an intrinsic viscosity of 0.63 dL/g.

Thereafter, 10 parts by weight of the reaction product, 0.2 parts by weight of amine-modified polysiloxane of formula (I), with a number average molecular weight of about 18000, and 8 parts by weight of polyisocyanate of formula (II) were dissolved in 260 parts by weight of methyl ethyl ketone to prepare a heat-resistant protective layer coating liquid.

The heat-resistant protective layer coating liquid was coated on one side of a PET film with a thickness of 4.5 μm, serving as a support, and dried at 115° C. for 30 sec, so that a heat-resistant protective layer with a thickness of 0.5 μm was formed on the support. The heat-resistant protective layer had a tensile strength of 280 kg/cm$^2$.

Formation of Ink Layer 80 parts by weight of an emulsion of methyl methacrylate—acrylonitrile—butyl methacrylate copolymer with a solid content of 50% and 20 parts by weight of a carbon black dispersion containing 20 wt. % of carbon black therein were mixed to prepare an ink layer coating liquid.

The thus obtained ink layer coating liquid was coated on the other side of the support, that is, opposite to the protective layer with respect to the support, and dried, so that an ink layer with a thickness of 4 μm was formed on support.

Thus, a thermal image transfer recording medium No. 4 according to the present invention was obtained.

EXAMPLE 5

Formation of Heat-resistant Protective Layer 150 parts by weight of amino-modified polysiloxane formula (I) were added to 100 parts by weight of dimethyl acetoamide to obtain a mixture.

To the thus obtained mixture, a solution obtained by dissolving 45 parts by weight of polyisocyanate of formula (III) in 100 parts by weight of methyl ethyl ketone was added dropwise over a period of 30 minutes with stirring in a stream of nitrogen at 0° C.

After the completion of the addition, the above obtained mixture was stirred at 0° C. for 30 minutes. With the temperature of the mixture gradually increased, the mixture was further stirred at 50° C. for 12 hours to obtain a reaction product. The above reaction product had an intrinsic viscosity of 0.68 dL/g.

Thereafter, 10 pares by weight of the reaction product, 0.1 parts by weight of the amine-modified polysiloxane with a number average molecular weight of about 4700 of formula (IV), and 12 parts by weight of polyisocyanate of formula (III) were dissolved in 300 parts by weight of methyl ethyl ketone to prepare a heat-resistant protective layer coating liquid.

The heat-resistant protective layer coating liquid was coated on one side of a PET film with a thickness of 4.5 μm, serving as a support, and dried at 105° C. for 30 sec, so that a heat-resistant protective layer with a thickness of 0.5 μm was formed on the support. The heat-resistant protective layer had a breaking extension of 300%.

Formation of Ink Layer 50 parts by weight by weight of candelilla wax were dissolved in 320 parts by weight of toluene under application of heat thereto to obtain a solution. 10 parts by weight of carbon black were dispersed in the above obtained solution in a ball mill to prepare an ink layer coating liquid.

The thus obtained ink layer coating liquid was coated on the other side of the support, that is, opposite to the protective layer with respect to the support, and dried, so that an ink layer with a thickness of 3 μm was formed on the support.

Thus, a thermal image transfer recording medium No. 5 according to the present invention was obtained.

COMPARATIVE EXAMPLE 1

Formation of Heat-resistant Protective Layer 5 parts by weight of silicone graft acrylic copolymer with a tensile strength of 50 kg/cm$^2$ or less and a breaking extension of 10% or less were dissolved in 95 parts by weight of methyl ethyl ketone to prepare a heat-resistant protective layer coating liquid.

The thus obtained heat-resistant protective layer coating liquid was coated on one side of a PET film with a thickens of 4.5 μm, serving as a support, and dried at 90° C. for 10 sec, so that a heat-resistant protective layer with a thickness of 0.6 μm was formed on the support.

Formation of Ink Layer

The procedure for preparation of the ink layer employed in Example 1 was repeated, so that an ink layer was formed on the other side of the support.

Thus, a comparative thermal image transfer recording medium No. 1 was prepared.

COMPARATIVE EXAMPLE 3

Formation of Heat-resistant Protective Layer 5 parts by weight of the reaction produce employed in Example 3 were dissolved in 95 parts by weight of a mixed solution of methyl ethyl ketone and toluene with a mixing ratio of (90:10) to prepare a heat-resistant protective layer coating liquid.

The thus obtained heat-resistant protective layer coating liquid was coated on one side of a PET film with a thickness of 4.5 μm serving as a support, and dried at 105° C. for 10 sec, so that a heat-resistant protective layer a thickness of 0.6 μm was formed on the support.

Formation of Ink Layer

The procedure for preparation of the ink layer employed in Example 3 was repeated, so that an ink layer was formed on the other side of the support.

Thus, a comparative thermal image transfer recording medium No. 2 was prepared.

COMPARATIVE EXAMPLE 3

Formation of Heat-resistant Protective Layer 10 parts by weight of the reaction product employed in Example 3 and 5 parts by weight of polyisocyanate of formula (V) were dissolved in 260 parts by weight of methyl ethyl ketone to prepare a heat-resistant protective layer coating liquid.

The thus obtained heat-resistant protective layer coating liquid was coated on one side of a PET film with a thickness of 4.5 μm, serving as a support, and dried at 105° C. for 10 sec, so that a heat-resistant protective layer with a thickness of 0.6 μm was formed on the support.

Formation of Ink Layer

The procedure for preparation of the ink layer employed in Example 3 was repeated, so that an ink layer was formed on the other side of the support.

Thus, a comparative thermal image transfer recording medium No. 3 was prepared.

COMPARATIVE EXAMPLE 4

Formation of Hoar-resistant Protective Layer 5 parts by weight of silicone graft acrylic copolymer with a tensile strength of 50 kg/cm$^2$ or less and a breaking extension of 10% or less were dissolved in 95 parts by weight of methyl ethyl ketone to prepare a heat-resistant protective layer coating liquid.

The thus obtained heat-resistant protective layer coating liquid was coated on one side of a PET film with a thickness of 4.5 μm, serving as a support, and dried at 90° C. for 10 sec, so that a heat-resistant protective layer with a thickness of 0.5 μm was formed on the support.

Formation of Ink Layer

The procedure for preparation of the ink layer employed in Example 4 was repeated, so that an ink layer was formed on the other side of the support.

Thus, a comparative thermal image transfer recording medium No. 4 was prepared.

COMPARATIVE EXAMPLE 5

Formation of Heat-resistant Protective Layer 5 parts by weight of the reaction product employed in Example 5 were dissolved in 95 parts by weight of a mixed solution of methyl ethyl ketone and toluene with a mixing ratio of (90:10) to prepare a heat-resistant protective layer coating liquid.

The thus obtained heat-resistant protective layer coating liquid was coated on one side of a PET film with a thickness of 4.5 μm, serving as a support, and dried at 115° C. for 30 sec, so that a heat-resistant protective layer with a thickness of 0.5 μm was formed on one side of the support.

Formation of Ink Layer

The procedure for preparation of the ink layer employed in Example 5 was repeated, so that an ink layer was formed on the other side of the support.

Thus, a comparative thermal image transfer recording medium No. 5 was prepared.

EXAMPLE 6

Formation of Heat-resistant Protective Layer 10 parts by weight of bis(4-aminophenyl)ether were dissolved in 20 parts by weight of dimethyl acetoamide in an atmosphere of nitrogen to prepare a solution.

To the thus obtained solution, a solution obtained by dissolving 30 parts by weight of polyisocyanate of formula (II) in 20 parts by weight of methyl ethyl ketone was added dropwise over a period of 30 minutes with stirring at −10° C.

After the completion of the addition, the above mixture was stirred at 0° C. for one hour. With the temperature of the mixture gradually increased to room temperature, the mixture was stirred for 12 hours to obtain a reaction product. The intrinsic viscosity of the reaction product was 0.55 dL/g. The cast film obtained from the reaction product in the solvent had a tensile strength of 670 kg/cm$^2$, and a breaking extension of 90%.

Thereafter, 10 parts by weight of the reaction product, 4 pares by weight of polyisocyanate of formula (II), and 0.15 parts by weight of amino-modified polysiloxane (Compound No. 3) represented by the following formula (VI) with a number average molecular weight of about 4800 were dissolved in 280 parts by weight of methyl ethyl ketone to prepare a heat-resistant protective layer coating liquid.

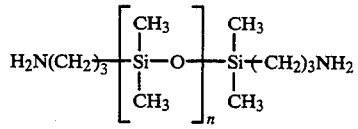

(VI)

The heat-resistant protective layer coating liquid was coated on one side of a PET film with a thickness of 4.5 μm, serving as a support, and dried at 105° C. for 10 sec, whereby a heat-resistant protective layer with a thickness of 0.5 μm was formed on the support.

Formation of Ink Layer 80 parts by weight of an emulsion of methyl methacrylate—acrylonitrile—butyl methacrylate copolymer with a solid content of 50% and 20 parts by weight of a carbon black dispersion containing 20 wt. % of carbon black therein were mixed to prepare an ink layer coating liquid. The thus obtained ink layer coating liquid was coated on the other side of the support, that is, opposite to the protective layer, and dried, so that an ink layer with a thickness of 4 μm was formed on the support.

Thus, a thermal image transfer recording medium No. 6 according to the present invention was obtained.

EXAMPLE 7

Formation of Heat-resistant Protective Layer 10 parts by weight of aromatic diamine represented by the following formula (VII) were dissolved in 20 parts by weight of dimethyl acetoamide In an atmosphere of nitrogen to prepare a solution.

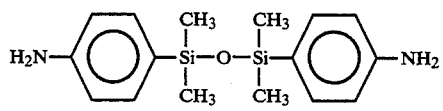

(VII)

To the above obtained solution, a solution obtained by dissolving 18 parts by weight of the polyisocyanate of formula (II) in 20 parts by weight of methyl ethyl ketone was added dropwise over a period of 30 minutes with stirring at 0° C.

After the completion of the addition, the mixture was stirred at 0° C. for one hour and then at 30° C. for 12 hours, so that a reaction product was obtained. The intrinsic viscosity of the reaction product was 0.62 dL/g. The cast film obtained from the solvent of the reaction product had a tensile strength of 480 kg/cm$^2$ and a breaking extension of 150%.

Thereafter, 10 parts by weight of the above-mentioned reaction product, 6 parts by weight of the polyisocyanate of formula (III), and 0.20 parts by weight of the amino-modified polysiloxane of formula (VI) were dissolved in 280 parts by weight of methyl ethyl ketone to prepare a heat-resistant protective layer coating liquid.

The thus obtained heat-resistant protective layer coating liquid was coated on the back side of a PET film with a thickness of 4.5 μm, serving as a support, and dried at 105° C. for 10 sec, so that a heat resistant-protective layer with a thickness of 0.5 μm was formed on the support.

Formation of Ink Layer 50 parts by weight of candelilla wax were dissolved in 320 parts by weight of toluene under application of heat thereto to prepare a solution. 10 parts by weight of carbon black was added to the above prepared solution and the mixture was dispersed in a ball mill, so that an ink layer coating liquid was obtained. The ink layer coating liquid was coated on the other side of the support, whereby an ink layer with a thickness of 3 μm was obtained.

Thus, a thermal image transfer recording medium No. 7 according to the present invention was obtained.

EXAMPLE 8

Formation of Heat-resistant Protective Layer 30 parts by weight of 3,4'-diaminodiphenyl ether were dissolved in 20 parts by weight of dimethyl acetoamide in an atmosphere of nitrogen to prepare a solution. To the above obtained solution, a solution obtained by dissolving 15 parts by weight of the polyisocyanate of formula (V) in 100 parts by weight of methyl ethyl ketone was added dropwise over a period of 30 minutes with stirring at −10° C.

After the completion of the addition, the mixture was further stirred at 0° C. for one hour. With the temperature of the mixture gradually increased to room temperature, the mixture was further stirred for 12 hours, so that a reaction product was obtained. The intrinsic viscosity of the reaction product was 0.71 dL/g. The cast film obtained from the reaction product in the solvent had a tensile strength of 290 kg/cm$^2$ and a breaking extension of 300%.

Thereafter, 10 parts by weight of the reaction product, 6 parts by weight of the polyisocyanate of formula (II), and 0.20 parts by weight of the amine-modified polysiloxane of the formula (VI) were dissolved in 300 parts by weight of methyl ethyl ketone to prepare a heat-resistant protective layer coating liquid.

The thus obtained heat-resistant protective layer coating liquid was coated on one side of a PET film with a thickness of 4.5 μm, serving as a support, and dried at 105° C. for 10 sec, so that a heat-resistant protective layer with a thickness of 0.5 μm was formed on the support.

Formation of Ink Layer 80 parts by weight of an emulsion of methyl methacrylate—acrylonitrile—methyl acrylate copolymer with a solid component of 50% and 20 parts by weight of a carbon black dispersion containing 20 wt. % of carbon black therein was coated on the other side of the support and dried, whereby an ink layer with a thickness of 5 μm was prepared on the support.

Thus, a thermal image transfer recording medium No. 8 according to the present invention was obtained.

EXAMPLE 9

Formation of Meat-resistant Protective Layer 10 parts by weight of the aromatic diamine of formula (VII) were dissolved in 20 parts by weight of dimethyl acetoamide in an atmosphere of nitrogen to prepare a solution. To the thus obtained solution, a solution obtained by dissolving 18 parts by weight of the polyisocyanate of formula (II) in 20 parts by weight of methyl ethyl ketone was added dropwise over a period of 30 minutes with stirring at 0° C.

After the completion of the addition, the mixture was further starred at 0° C. for one hour, and then at 30° C. for 12 hours, so that a reaction product was obtained. The intrinsic viscosity of the reaction product was 0.73 dL/g.

Thereafter, 10 parts by weight of the reaction product, 6 parts by weight of the polyisocyanate of formula (III), and 0.1 parts by weight of the amino-modified polysiloxane of formula (VI) were dissolved in 280 parts by weight of methyl ethyl ketone to prepare a heat-resistant protective layer coating liquid.

The heat-resistant protective layer coating liquid was coated on one side of a PET film with a thickness of 4.5 μm, serving am a support, and dried at 115° C. for 30 sec, so that a heat-resistant protective layer with a thickness of 0.5 μm was formed on the support.

The tensile strength of the thus prepared protective layer was 320 kg/cm$^2$.

Formation of Ink Layer 50 parts by weight of candelilla wax were dissolved in 320 parts by weight of toluene with the application of heat thereto to obtain a solution. Then, 10 parts by weight of carbon black was added to the above obtained solution and the mixture was dispersed in a ball mill to prepare an ink layer coating liquid.

The thus obtained ink layer coating liquid was coated on the other side of the support, so that an ink layer with a thickness of 3 μm was formed on the support.

Thus, a thermal image transfer recording medium No. 9 according to the present invention was obtained.

EXAMPLE 10

Formation of Heat-resistant Protective Layer 30 parts by weight of 3,4'-diaminodiphenylether were dissolved in 20 parts by weight of dimethyl acetoamide in an atmosphere of nitrogen to prepare a solution. To the thus obtained solution, a solution obtained by dissolving 15 parts by weight of the polyisocyanate of formula (V) in 100 parts by weight of methyl ethyl ketone was added dropwise over a period of 30 minutes with stirring at −10° C.

After the completion of the addition, the above obtained mixture was stirred at 0° C. for one hour. With the temperature of the mixture gradually increased to room temperature, the mixture was further stirred for 12 hours, so that a reaction product was obtained. The intrinsic viscosity of the reaction product was 0.55 dL/g.

Thereafter, 10 parts by weight of the above prepared reaction product, 12 parts by weight of the polyisocyanate of formula (II), and 0.1 parts by weight of the amino-modified polysiloxane of formula (VI) were dissolved in 300 parts by weight of methyl ethyl ketone to prepare a heat-resistant protective layer coating liquid.

The heat-resistant protective layer coating liquid was coated on one side of a PET film with a thickness of 4.5 μm, serving as a support, and dried at 115° C. for 30 sec, so that a heat-resistant protective layer with a thickness of 0.5 μm was formed on the support.

The heat-resistant protective layer had a breaking extension of 190%.

Formation of Ink Layer 80 parts by weight of an emulsion of methyl methacrylate—acrylonitrile—methyl acrylate copolymer with a solid content of 50% and 20 parts by weight of a carbon black dispersion containing 20 wt. % of carbon black therein were mixed to prepare an ink layer coating liquid. The thus obtained ink layer coating liquid was coated on the other side of the support, that is, opposite of the protective layer, so that an ink layer with a thickness of 5 μm was formed on the support.

Thus, a thermal image transfer recording medium No. 10 according to the present invention was obtained.

COMPARATIVE EXAMPLE 6

Formation of Heat-resistant Protective Layer 5 parts by weight of the reaction product obtained in Example 8 were dissolved in 95 parts by weight of a mixed solution of methyl ethyl ketone and toluene with a mixing ratio of (90:10) to prepare a heat-resistant protective layer coating liquid.

The thus obtained heat-resistant protective layer coating liquid was coated on one side of a PET film with a thickness of 4.5 μm, serving as a support, and dried at 105°0 C. for 10 sec, so that a heat-resistant protective layer with a thickness of 0.6 μm was formed on the support.

Formation of Ink Layer

The procedure for preparation of the ink layer in Example 8 was repeated, so that an ink layer was formed on the other side of the support.

Thus, a comparative thermal image transfer recording medium No. 6 was prepared.

COMPARATIVE EXAMPLE 7

Formation of Heat-resistant Protective Layer 10 parts by weight of the reaction product obtained in Example 8 and 5 parts by weight of polyisocyanate of formula (V) were dissolved in 260 parts by weight of methyl ethyl ketone no prepare a heat-resistant protective layer coating liquid. The thus obtained heat-resistant protective layer coating liquid was coated on one side of a PET film with a thickness of 4.5 μm, serving as a support, and dried at 105° C. for 10 sec, so that a heat-resistant protective layer with a thickness of 0.6 μm was formed on the support.

Formation of Ink Layer

The procedure for preparation of the ink layer in Example 8 was repeated, so that an ink layer was formed on the other side of the support.

Thus, a comparative thermal image transfer recording medium No. 7 was obtained.

COMPARATIVE EXAMPLE 8

Formation of Heat-resistant Protective Layer 5 parts by weight of the reaction product obtained in Example 9 were dissolved in 95 parts by weight of a mixed solution of methyl ethyl ketone and toluene with a mixing ratio of (90:10) to prepare a heat-resistant protective layer coating liquid. The thus obtained heat-resistant protective layer coating liquid was coated on one side of a PET film with a thickness of 4.5 μm, serving as a support, and dried at 115° C. for 30 sec, so that a heat-resistant protective layer with a thickness of 0.5 μm was formed on the support.

Formation of Ink Layer

The procedure for preparation of the ink layer in Example 9 was repeated, so that an ink layer was formed on other side of the support.

Thus, a comparative thermal image transfer recording medium No. 8 was obtained.

COMPARATIVE EXAMPLE 9

Formation of Heat-resistant Protective Layer 10 parts by weight of the reaction product obtained in Example 10 and 5 parts by weight of the polyisocyanate of formula (V) were dissolved in 260 parts by weight of methyl ethyl ketone to prepare a heat-resistant protective layer coating liquid. The thus obtained heat-resistant protective layer coating liquid was coated on one side of a PET film with a thickness of 4.5 μm, serving as a support, and dried at 115° C. for 30 sec, so that a heat-resistant protective layer with a thickness of 0.6 μm was formed on the support.

Formation of Ink Layer

The procedure for preparation of the ink layer in Example 10 was repeated, so that an ink layer was formed on the other side of the support.

Thus, a comparative thermal image transfer recording medium No. 9 was obtained.

EXAMPLE 11

Formation of Heat-resistant Protective Layer 150 parts by weight of alcohol-modified polysiloxane with a number average molecular weight of about 3000 represented by the following formula (VIII) were added to a mixed solvent containing 100 parts by weight of dimethylformamide and 150 parts by weight of methyl ethyl ketone to prepare a mixture.

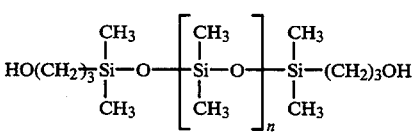

(VIII)

To the thus obtained mixture, a solution obtained by dissolving 37 parts by weight of hydrogenated 4,4'-methylenebis(phenylisocyanate) in 50 parts by weight of methyl ethyl ketone was added dropwise over a period of 15 minutes with stirring in a stream of nitrogen at 0° C.

After the completion of the addition, the above obtained mixture was stirred at 0° C. for 30 minutes. With the temperature of the mixture gradually increased, the mixture was further stirred at 50° C. for 12 hours, so that a reaction product was obtained. The intrinsic viscosity of the above reaction product was 0.62 dL/g. The cast film obtained from the reaction product in the solvent had a tensile strength of 190 kg/cm$^2$, and a breaking extension of 570%.

Thereafter, 10 parts by weight of the above prepared reaction product, 4 parts by weight of the polyisocyanate of formula (II), and 0.1 parts by weight of alcohol-modified polysiloxane represented by the following formula (IX) were dissolved in 280 parts by weight of methyl ethyl ketone to prepare a heat-resistant protective layer coating liquid:

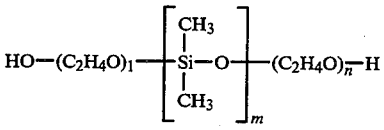

(IX)

The heat-resistant protective layer coating liquid was coated on one side of a PET film with a thickness of 4.5 μm, serving as a support, and dried at 105° C. for 10 sec, so that a heat-resistant protective layer with a thickness of 0.5 μm was formed on the support.

Formation of Ink Layer 80 parts by weight of an emulsion of methyl methacrylate—acrylonitrile—butyl methacrylate copolymer with a solid content of 50% and 20 parts by weight of a carbon black dispersion containing 20 wt. % of carbon black therein were mixed to prepare an ink layer coating liquid.

The thus obtained ink layer coating liquid was coated on the other side of the support and dried, so that an ink layer with a thickness of 4 μm was formed on the support.

Thus, a thermal image transfer recording medium No. 11 according to the present invention was obtained.

EXAMPLE 12

Formation of Heat-resistant Protective Layer 10 parts by weight of the reaction product obtained in Example 11, 5 parts by weight of the polyisocyanate of formula (III), and 0.15 parts by weight of the alcohol-modified polysiloxane of formula (VIII) were dissolved in 320 parts by weight of methyl ethyl ketone to obtain a heat-resistant protective layer coating liquid.

The heat-resistant protective layer coating liquid was coated on one side of a PET film with a thickness of 4.5 μm, serving as a support, and dried at 105° C. for 10 sec, so that a heat-resistant protective layer with a thickness of 0.6 μm was formed on the support.

Formation of Ink Layer 50 parts by weight of candelilla wax were dissolved in 320 parts by weight of toluene with the application of heat thereto. To this solution, 10 parts by weight of carbon black were added, and the mixture was dispersed in a ball mill to prepare an ink layer coating liquid.

The thus obtained ink layer coating liquid was coated on the other side of the support and dried, so that an ink layer with a thickness of 3 μm was obtained on the support.

Thus, a thermal image transfer recording medium No. 12 according to the present invention was obtained.

EXAMPLE 13

Formation of Heat-resistant Protective Layer 150 parts by weight of the alcohol-modified polysiloxane with a number average molecular weight of 1800 of formula (VIII) were added to a mixed solvent containing 100 parts by weight of dimethylformamide and 150 parts by weight of methyl ethyl ketone to prepare a mixture. To the thus obtained mixture, a solution obtained by dissolving 37 parts by weight of hydrogenated 4,4'-methylenebis(phenylisocyanate) in 50 parts by weight of methyl ethyl ketone was added dropwise over a period of 15 minutes with stirring in a stream of nitrogen at 0° C.

After the completion of the addition, the above obtained mixture was stirred at 0° C. for 30 minutes. With the temperature of the mixture gradually increased, the mixture was further stirred at 50° C. for 12 hours, so that a reaction product was obtained.

The intrinsic viscosity of the above obtained reaction product was 0.58 dL/g. The cast film obtained from the reaction product in the solvent had a tensile strength of 110 kg/cm$^2$, and a breaking extension of 670%.

Thereafter, 10 parts by weight of the above prepared reaction product, 5 parts by weight of the polyisocyanate of formula (II), and 0.15 parts by weight of the alcohol-modified polysiloxane of formula (VIII) were dissolved in 300 parts by weight of methyl ethyl ketone to prepare a heat-resistant protective layer coating liquid.

The heat-resistant protective layer coating liquid was coated on one side of a PET film with a thickness of 4.5 μm, serving as a support, and dried at 105° C. for 10 sec, so that a heat-resistant protective layer with a thickness of 0.5 μm was formed on the support.

Formation of Ink Layer 80 parts by weight of an emulsion of methyl methacrylate—acrylonitrile—methyl methacrylate copolymer with a solid content of 50% and 20 parts by weight of a carbon black dispersion containing 20 wt. % of carbon black therein were mixed to prepare an ink layer coating liquid. The ink layer coating liquid was coated on the other side of the support and dried, so that an ink layer with a thickness of 5 μm was formed on the support.

Thus, a thermal image transfer recording medium No. 13 according to the present invention was obtained.

EXAMPLE 14

Formation of Meat-resistant Protective Layer 150 parts by weight of the alcohol-modified polysiloxane with a number average molecular weight of about 3000 of formula (VIII) were added to a mixed solvent containing 100 parts by weight of dimethylformamide and 150 parts by weight of methyl ethyl ketone to prepare a mixture. To the thus obtained mixture, a solution obtained by dissolving 37 parts by weight of hydrogenated 4,4'-methylenebis(phenylisocyanate) in 50 parts by weight of methyl ethyl ketone was added dropwise over a period of 30 minutes with stirring at 0° C. in a stream of nitrogen.

After the completion of the addition, the above obtained mixture was stirred at 0° C. for 2 hours. With the temperature of the solution gradually increased, the mixture was further stirred at 60° C. for 12 hours, so that a reaction product was obtained. The intrinsic viscosity of the above reaction product was 0.65 dL/g.

Thereafter, 10 parts by weight of the above prepared reaction product, 8 parts by weight of the polyisocyanate of formula (II), and 0.1 parts by weight of the alcohol-modified polysiloxane with a number average molecular weight of about 2000 of formula (IX) were dissolved in 240 parts by weight of methyl ethyl ketone to prepare a heat-resistant protective layer coating liquid.

The heat-resistant protective layer coating liquid was coated on one side of a PET film with a thickness of 4.5

μm, serving as a support, and dried at 115° C. for 1 min, so that a heat-resistant protective layer with a thickness of 0.5 μm was formed on the support.

The tensile strength of the above formed heat-resistant protective layer was 200 kg/cm$^2$.

Formation of Ink Layer 80 parts by weight of an emulsion of methyl methacrylate—acrylonitrile—butyl methacrylate copolymer with a solid content of 50% and 20 parts by weight of a carbon black dispersion containing 20 wt. % of carbon black therein were mixed to prepare an ink layer coating liquid. The ink layer coating liquid was coated on the other side of the support and dried, so that an ink layer with a thickness of 4 μm was formed on the support.

Thus, a thermal image transfer recording medium No. 14 according to the present invention was obtained.

EXAMPLE 15

Formation of Heat-resistant Protective Layer 10 parts by weight of the reaction product obtained in Example 14, 5 parts by weight of the polyisocyanate of formula (III), and 0.15 parts by weight of the alcohol-modified polysiloxane of formula (VIII) were dissolved in 320 parts by weight of methyl ethyl ketone to prepare a heat-resistant protective layer coating liquid.

The heat-resistant protective layer coating liquid was coated on one side of a PET film, serving as a support with a thickness of 4.5 μm, and dried at 115° C. for 1 min, so that a heat-resistant protective layer with a thickness of 0.5 μm was formed on the support.

Formation of Ink Layer 50 parts by weight of candelilla wax were dissolved in 320 parts by weight of toluene under application of heat thereto. To this solution, 10 parts by weight of carbon black were added, and the mixture was dispersed in a ball mill to prepare an ink layer coating liquid.

The thus obtained ink layer coating liquid was coated on the other side of the support, whereby an ink layer with a thickness of 3 μm was formed on the support.

Thus, a thermal image transfer recording medium No. 15 according to the present invention was obtained.

COMPARATIVE EXAMPLE 10

The procedure for preparation of the thermal image transfer recording medium No. 11 obtained in Example 11 was repeated except that the heat-resistant protective layer coating liquid in Example 11 was changed to a solution containing only the reaction product obtained In Example 11, whereby a comparative thermal image transfer recording medium No. 10 was prepared.

COMPARATIVE EXAMPLE 11

Formation of Heat-resistant Protective Layer 15 parts by weight of the alcohol-modified polysiloxane of formula (VIII) and 5 parts by weight of polyisocyanate of formula (II) were dissolved in 400 parts by weight of methyl ethyl ketone to prepare a heat-resistant protective layer coating liquid.

The thus obtained heat-resistant protective layer coating liquid was coated on one side of a PET film with a thickness of 4.5 μm, serving as a support, and dried at 105° C. for 20 sec, so that a heat-resistant protective layer with a thickness of 0.65 μm was formed on the support.

Formation of Ink Layer

The procedure for preparation of the ink layer in Example 12 was repeated, whereby an ink layer was formed on the other side of the support.

Thus, a comparative thermal image transfer recording medium No. 11 was obtained.

Comparative Example 12

Formation of Heat-resistant Protective Layer 10 parts by weight of the reaction product obtained in Example 14 were dissolved in 250 parts by weight of methyl ethyl ketone to prepare a heat-resistant protective layer coating liquid. The heat-resistant protective layer coating liquid was coated on one side of a PET film with a thickness of 4.5 μm, serving as a support, and dried at 115° C. for 1 min, so that a heat-resistant protective layer with a thickness of 0.5 μm was formed on the support.

Formation of Ink Layer

The procedure for preparation of the ink layer in Example 14 was repeated, whereby an ink layer was formed on other side of the support.

Thus, a comparative thermal image transfer recording medium No. 12 was obtained.

COMPARATIVE EXAMPLE 13

Formation of Heat-resistant Protective Layer 10 parts by weight of the reaction product obtained in Example 15 and 5 parts by weight of the polyisocyanate of formula (III) were dissolved in 260 parts by weight of methyl ethyl ketone to prepare a heat-resistant protective layer coating liquid.

The heat-resistant protective layer coating liquid was coated on one side of a PET film with a thickness of 4.5 μm serving as a support, and dried at 115° C. for 1 minute, so that a heat-resistant protective layer with a thickness of 0.5 μm was prepared on the support.

Formation of Ink Layer

The procedure for preparation of the ink layer in Example 15 was repeated, whereby an ink layer was formed on the other side of the support.

Thus, a comparative thermal image transfer recording medium No. 13 was obtained.

Using each of the above obtained thermal image transfer recording media Nos. 1 to 15 according to the present invention and comparative thermal image transfer recording media Nos. 1 to 13, thermal printing was performed with the application of heat to each recording medium by using a thermal head. As a result, the coefficient of dynamic friction was measured and the transport performance and the dust adhesion to the thermal head were evaluated in accordance with the following methods. Furthermore, the blocking resistance of each thermal image transfer recording medium was evaluated in a storage condition. The results are shown in Tables 1 and 2.

(1) Transport performance

Each recording medium was caused to pass the thermal head once at a speed of 3 inch/sec, and 6 inch/sec, with the thermal energy applied to the thermal head being changed to 6, 19, 22, 25 and 28 mJ/mm$^2$.

In addition, each recording medium was caused to pass the thermal head three times at a speed of 2 inch/-sec, with the thermal energy of 22 mJ/mm$^2$ applied to the thermal head.

The transport performance was evaluated in accordance with the following scale:

o: No problems.

Δ: The sticking problem occurred.

x: The support was broken.

(2) Dust adhesion to thermal head

Each recording medium was caused to continuously transport, and the duet adhesion to the thermal head was evaluated in accordance with the following scale:

◎: Dust adhesion to the thermal head was not observed even after the recording medium with a length of 10 km or more was subjected to continuous thermal transfer recording.

o: Dust adhesion to the thermal head was not observed after the recording medium with a length of 1 km was subjected to continuous thermal transfer recording.

Δ: Dust adhesion to the thermal head was observed while the recording medium with a length of 500 m or more to less than 1 km was subjected to continuous thermal transfer recording.

x: Dust adhesion to a thermal head was observed until the recording medium with a length of 500 m was subjected to continuous thermal transfer recording.

(3) Blocking resistance

Each thermal image transfer recording medium was wound and allowed to stand at 60° C. for 72 hours, with the surface of the ink layer brought into contact with the surface of the heat-resistant protective layer under application of a pressure of 6.00 kg/cm$^2$ thereto. Then, this item was evaluated in accordance with the following scale:

x: The blocking phenomenon was observed between the adjoining ink layer and heat-resistant protective layer.

Δ: The blocking phenomenon was partially observed between the adjoining ink layer and heat-resistant protective layer.

o: No blocking phenomenon occurred.

As can be seen from the results in Tables 1 and 2, the thermal image transfer recording media No. 1 to 15 according to the present invention are excellent with respect to the transport performance, and the blocking resistance, and the problem of dust adhesion to a thermal head can be solved even when the thermal transfer is performed with a large amount of thermal energy applied to the thermal head or the multiple-time thermal transfer was conducted.

TABLE 1

| Ex. No. | Coefficient of Dynamic Friction | Transport Performance (One-time Image Transfer) 3 in./sec Thermal Energy (mJ/mm$^2$) 16 | 19 | 22 | 25 | 28 | 6 in./sec Thermal Energy (mJ/mm$^2$) 16 | 19 | 22 | 25 | 28 | Transport Performance (Multiple-time Image Transfer) 1st time | 2nd time | 3rd time | Blocking Resistance | Dust Adhesion to Thermal Head |
|---|---|---|---|---|---|---|---|---|---|---|---|---|---|---|---|---|
| 1 | 0.05 | o | o | o | o | o | o | o | o | o | Δ | o | o | o | o | o |
| 2 | 0.04 | o | o | o | o | o | o | o | o | o | Δ | o | o | o | o | o |
| 3 | 0.05 | o | o | o | o | o | o | o | o | o | o | o | o | o | o | ◎ |
| 4 | 0.05 | o | o | o | o | o | o | o | o | o | o | o | o | o | o | o |
| 5 | 0.06 | o | o | o | o | o | o | o | o | o | Δ | o | o | o | o | o |
| 6 | 0.06 | o | o | o | o | o | o | o | o | o | o | o | o | o | o | o |
| 7 | 0.05 | o | o | o | o | o | o | o | o | o | o | o | o | o | o | o |
| 8 | 0.05 | o | o | o | o | o | o | o | o | o | o | o | o | o | o | ◎ |
| 9 | 0.06 | o | o | o | o | o | o | o | o | o | o | o | o | o | o | o |
| 10 | 0.06 | o | o | o | o | o | o | o | o | o | Δ | o | o | o | o | ◎ |
| 11 | 0.06 | o | o | o | o | o | o | o | o | o | Δ | o | o | Δ | o | o |
| 12 | 0.05 | o | o | o | o | o | o | o | o | o | Δ | o | o | Δ | o | ◎ |
| 13 | 0.05 | o | o | o | o | o | o | o | o | o | o | o | o | o | o | ◎ |
| 14 | 0.06 | o | o | o | o | o | o | o | o | o | o | o | o | o | o | o |
| 15 | 0.05 | o | o | o | o | o | o | o | o | o | Δ | o | o | o | o | ◎ |

TABLE 2

| Ex. No. | Coefficient of Dynamic Friction | Transport Performance (One-time Image Transfer) 3 in./sec Thermal Energy (mJ/mm$^2$) 16 | 19 | 22 | 25 | 28 | 6 in./sec Thermal Energy (mJ/mm$^2$) 16 | 19 | 22 | 25 | 28 | Transport Performance (Multiple-time Image Transfer) 1st time | 2nd time | 3rd time | Blocking Resistance | Dust Adhesion to Thermal Head |
|---|---|---|---|---|---|---|---|---|---|---|---|---|---|---|---|---|
| 1 | 0.03 | o | o | o | o | o | o | o | o | o | o | o | o | o | o | X |
| 2 | 0.08 | o | Δ | Δ | X | X | o | Δ | Δ | X | X | Δ | X | X | X | X |
| 3 | 0.07 | o | o | o | Δ | Δ | o | o | Δ | X | X | o | Δ | Δ | X | Δ |
| 4 | 0.03 | o | o | o | o | o | o | o | o | o | o | o | o | o | o | X |
| 5 | 0.08 | o | Δ | Δ | X | X | o | Δ | Δ | X | X | Δ | X | X | X | X |
| 6 | 0.09 | o | o | Δ | X | X | o | o | Δ | X | X | Δ | X | X | X | Δ |
| 7 | 0.09 | o | o | o | o | Δ | o | o | o | Δ | Δ | o | o | Δ | Δ | Δ |
| 8 | 0.09 | o | o | Δ | X | X | o | o | Δ | X | X | Δ | X | X | X | Δ |
| 9 | 0.09 | o | o | o | o | Δ | o | o | o | Δ | Δ | o | o | Δ | Δ | Δ |
| 10 | 0.09 | o | o | Δ | X | X | o | o | Δ | X | X | Δ | X | X | X | X |
| 11 | 0.09 | o | o | Δ | Δ | Δ | o | o | Δ | Δ | X | Δ | X | X | X | X |
| 12 | 0.09 | o | o | Δ | X | X | o | Δ | X | X | X | Δ | X | X | X | X |

TABLE 2-continued

| Ex. No. | Coefficient of Dynamic Friction | Transport Performance (One-time Image Transfer) 3 in./sec Thermal Energy (mJ/mm²) 16 | 19 | 22 | 25 | 28 | 6 in./sec Thermal Energy (mJ/mm²) 16 | 19 | 22 | 25 | 28 | Transport Performance (Multiple-time Image Transfer) 1st time | 2nd time | 3rd time | Blocking Resistance | Dust Adhesion to Thermal Head |
|---|---|---|---|---|---|---|---|---|---|---|---|---|---|---|---|---|
| 13 | 0.09 | ○ | ○ | Δ | Δ | Δ | ○ | ○ | Δ | Δ | X | Δ | X | X | X | X |

What is claimed is:

1. A thermal image transfer recording medium, comprising a support, a thermal image transfer ink layer formed on said support, and a heat-resistant protective layer formed on the back side of said support, opposite to said thermal image transfer ink layer with respect to said support, said heat-resistant protective layer having a tensile strength effective to prevent said protective layer from adhering to a thermal head and to prevent loss of flexibility of said protective layer, said heat-resistant protective layer, comprising an amount of each of (i) amino-modified polysiloxane, (ii) a polyisocyanate and (iii) a reaction product of said amino-modified polysiloxane and said polyisocyanate effective for obtaining said tensile strength in said heat-resistant protective layer.

2. The thermal image transfer recording medium as claimed in claim 1, wherein said heat-resistant protective layer has a tensile strength in the range of 100 to 700 kg/cm².

3. The thermal image transfer recording medium as claimed in claim 1, wherein said heat-resistant protective layer has a breaking extension of at least, 50%.

4. The thermal image transfer recording medium as claimed in claim 1, wherein said amine-modified polysiloxane includes at least one amine group at the end of a siloxane segment or in a side chain thereof.

5. The thermal image transfer recording medium as claimed in claim 4, wherein said amino-modified polysiloxane is selected from the group consisting of compounds (I), (II), (III), (IV), (V), (VI), and (VII):

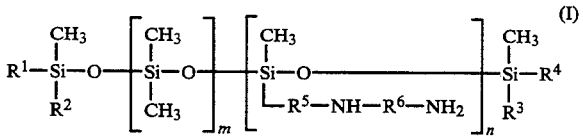

(I)

wherein $R^1$, $R^2$, $R^3$, and $R^4$ each represent a methyl group or a methoxy group, $R^5$ and $R^6$ each represent an alkylene group having 1 to 10 carbon atoms, and m and n each represent an integer of 1 to 20;

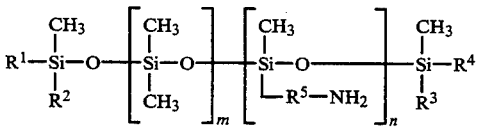

(II)

wherein, $R^1$, $R^2$, $R^3$, and $R^4$ each represent a methyl group or a methoxy group, $R^5$ represents an alkylene group having 1 to 10 carbon atoms, and m and n each represent an integer of 1 to 20;

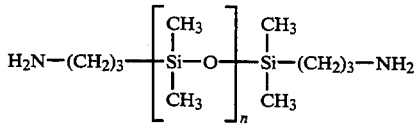

(III)

wherein n represents an integer of 1 to 300;

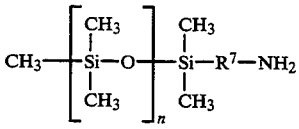

(IV)

wherein $R^7$ represents an alkylene group having 1 to 10 carbon atoms, and n represents an integer of 1 to 300;

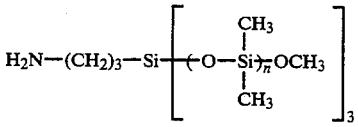

(V)

wherein n represents an integer of 2 to 20;

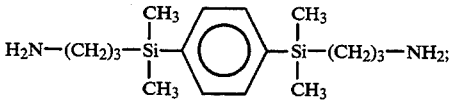

(VI)

and

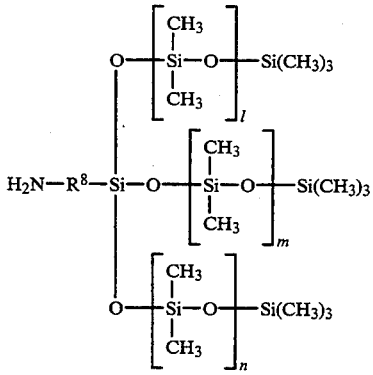

(VII)

wherein $R^8$ represents an alkylene group having 1 to 10 carbon atoms, and l, m and n each represent an integer of 1 to 300.

6. The thermal image transfer recording medium as claimed in claim 1, wherein said polyisocyanate is selected from the group consisting of an aliphatic polyisocyanate compound having at least two isocyanate groups and an aromatic polyisocyanate compound having at least two isocyanate groups.

7. The thermal image transfer recording medium as claimed in claim 6, wherein said aliphatic polyisocyanate compound is 4-methoxy-2,4-diiaocyanate.

8. The thermal image transfer recording medium as claimed in claim 6, wherein said aromatic polyisocyanate compound is selected from the group consisting of toluene-2,4-diisocyanate, toluene-2,6-diimocyanate, 4-isopropyl-1,3-phenyleneaiisocyanate, 4-chloro-1,3-phenylenediisocyanate, 4-butoxy-1,3-phenylenediisocyanate, 2,4-diisocyanatediphenylether, 4,4-methylenebis(phenylisocyanate), 1,5-naphthalene diisocyanate, benzidine isocyanate, o-nitrobenzidine diisocyanate, 4,4-diisocyanate benzyl, m-phenylene diisocyanate, p-phenylene diisocyanate, 1,3-xylene diisocyanane, and 1,4-xylene diisocyanate.

9. The thermal image transfer recording medium as claimed in claim 1, wherein said heat-resistant protective layer has a thickness of 0.1 to 3.0 μm.

10. The thermal image transfer recording medium as claimed in claim 1, further comprising an overcoat layer provided on said thermal image transfer ink layer.

11. A thermal image transfer recording medium, comprising a support, a thermal image transfer ink layer formed on said support, and a heat-resistant protective layer formed on the back side of said support, opposite to said thermal image transfer ink layer with respect to said support, said heat-resistant protective layer having a tensile strength effective to prevent said protective layer from adhering to a thermal head and to prevent loss of flexibility of said protective layer, said heat-resistant protective layer, comprising an amount of each of (i) an amino-modified polysiloxane, (ii) a polyisocyanate and (iii) a reaction product of an aromatic diamine and said polyisocyanate effective for obtaining said tensile strength in said heat-resistant protective layer.

12. The thermal image transfer recording medium as claimed in claim 11, wherein said heat-resistant protective layer has a tensile strength in the range of 100 to 700 kg/cm$^2$.

13. The thermal image transfer recording medium as claimed in claim 11, wherein said heat-resistant protective layer has a breaking extension of at least, 50%.

14. The thermal image transfer recording medium as claimed in claim 11, wherein said amino-modified polysiloxane include at least one amino group at the end of a siloxane segment or in a side chain thereof.

15. The thermal image transfer recording medium as claimed in claim 14, wherein said amino-modified polysiloxane is selected from the group consisting of compounds (I), (II), (III), (IV), (V), (VI) and (VII):

(I)

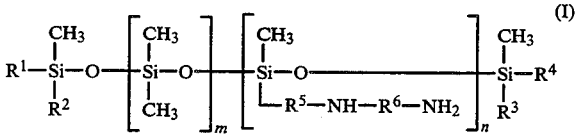

wherein $R^1$, $R^2$, $R^3$, and $R^4$ each represent a methyl group or a methoxy group, $R^5$ and $R^6$ each represent an alkylene group having 1 to 10 carbon atoms, and m and n each represent an integer of 1 to 20;

(II)

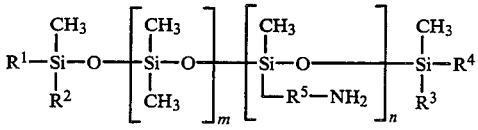

wherein $R^1$, $R^2$, $R^3$, and $R^4$ each represent a methyl group or a methoxy group, $R^5$ represents an alkylene group having 1 to 10 carbon atoms, and m and n each represents an integer of 1 to 20;

(III)

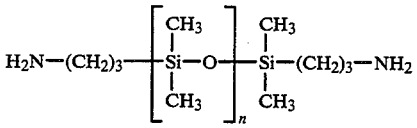

wherein n represents an integer of 1 to 300;

(IV)

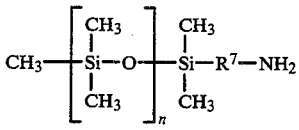

wherein $R^7$ represents an alkylene group having 1 to 10 carbon atoms, and n represents an integer of 1 to 300;

(V)

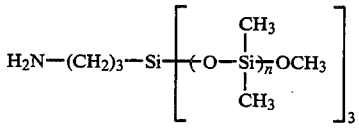

wherein n represents an integer of 2 to 20;

(VI)

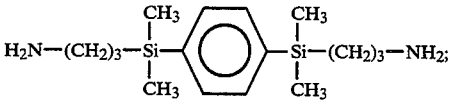

and (VII)

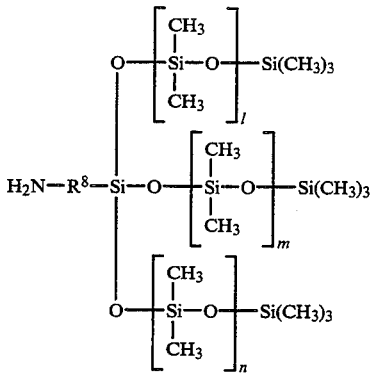

wherein $R^8$ represents an alkylene group having 1 to 10 carbon atoms, and l, m and n each represent an integer of 1 to 300.

16. The thermal image transfer recording medium as claimed in claim 11, wherein said polyisocyanate is selected from the group consisting of an aliphatic polyisocyanate compound having at least two isocyanate groups and an aromatic polyisocyanate compound having at least two isocyanate groups.

17. The thermal image transfer recording medium as claimed in claim 16, wherein said aliphatic polyisocyanate compound is 4-methoxy-2,4-dlisocyanate.

18. The thermal image transfer recording medium as claimed in claim 16, wherein said aromatic polyisocyanate compound is selected from the group consisting of toluene-2,4-diisocyanate, toluene-2,6-diisocyanate, 4-isopropyl-1,3-phenylenediisocyanate, 4-chloro-1,3-phenylenediisocyanate, 4-butoxy-1,3-phenylenediisocyanate, 2,4-diisocyanatediphenylether, 4,4-methylenebis(phenylisocyanate), 1,5-naphthalene diisocyanate, benzidineisocyanate, o-nitrobenzidine diisocyanate, 4,4-diisocyanate benzyl, m-phenylene diisocyanate, p-phenylene diisocyanate, 1,3-xylene diizocyanate, and 1,4-xylene diisocyanate.

19. The thermal image transfer recording medium as claimed in claim 11, wherein said aromatic diamine is wherein $R^{11}$ represents

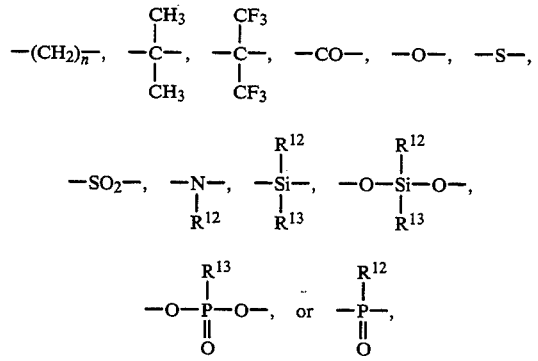

in which $R^{12}$ and $R^{13}$ each represent an aryl group having 1 to 30 carbon atoms or an alkyl group having 1 to 30 carbon atoms, and n represents an integer of 1 to 3;

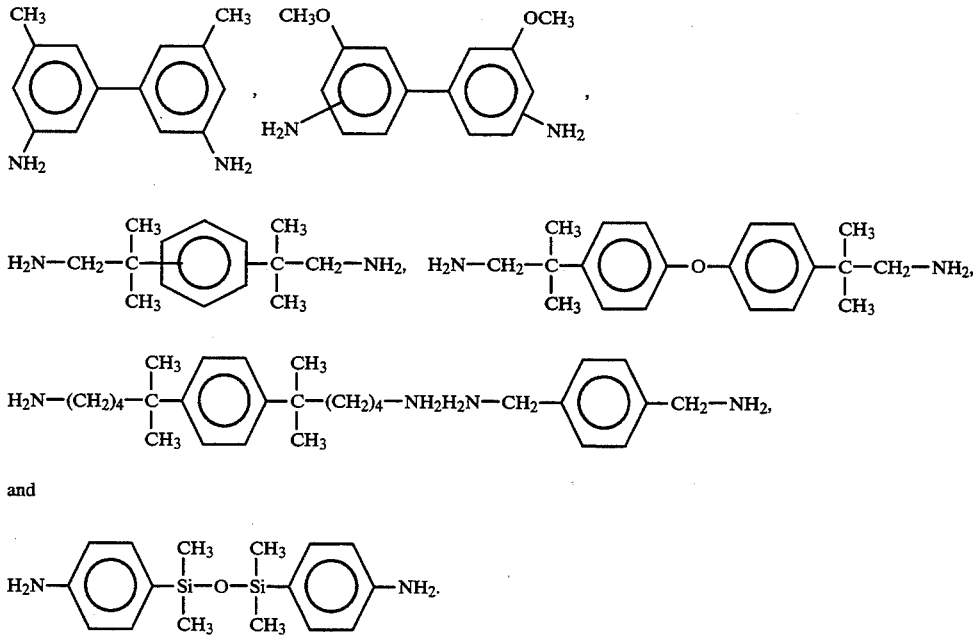

selected from the group consisting of:

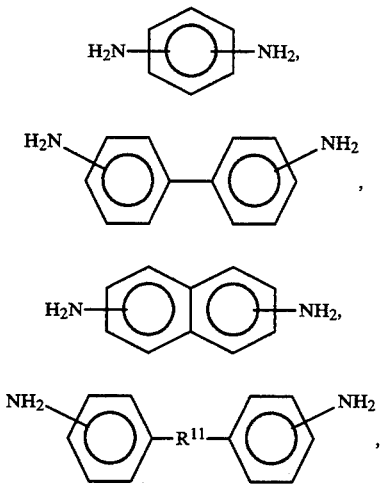

20. The thermal image transfer recording medium as claimed in claim 11, wherein said heat-resistant protective layer has a thickness of 0.1 to 3.0 μm.

21. The thermal image transfer recording medium as claimed in claim 11, further comprising an overcoat layer provided on said thermal image transfer ink layer.

22. A thermal image transfer recording medium, comprising a support, a thermal image transfer ink layer formed on said support, and a heat-resistant protective layer formed on the back side of the support, opposite to the thermal image transfer ink layer with respect to the support, said heat-resistant protective layer having a tensile strength effective to prevent said protective layer from adhering to a thermal head and to prevent loss of flexibility of said protective layer, said heat-resistant protective layer, comprising an amount of each of (i) an alcohol-modified polysiloxane, (ii) a polyisocyanate and (iii) a reaction product of said alcohol-modified polysiloxane and said polyisocyanate effective for obtaining said tensile strength in said heat-resistant protective layer.

23. The thermal image transfer recording medium as claimed in claim 1, wherein said heat-resistant protective layer has a tensile strength in the range of 100 to 700 kg/cm$^2$.

24. The thermal image transfer recording medium as claimed in claim 1, wherein said heat-resistant protective layer has a breaking extension of at least, 50%.

25. The thermal image transfer recording medium as claimed in claim 1, wherein said alcohol-modified polysiloxane has an alcohol hydroxyl group at the end of a siloxane segment or in a side chain thereof.

26. The thermal image transfer recording medium as claimed in claim 25, wherein said alcohol-modified polysiloxane is selected from the group consisting of compounds (VIII), (IX), (X), (XI) and (XII):

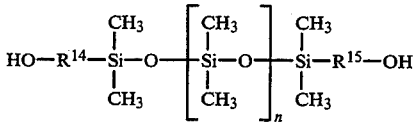

(VIII)

wherein $R^{14}$ and $R^{15}$ each represent an alkylene group having 1 to 10 carbon atoms, and n represents an integer of 1 to 300;

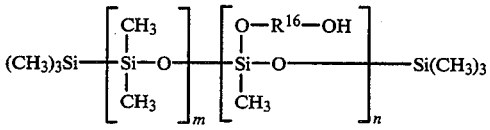

(IX)

wherein $R^{16}$ represents an alkylene group having 1 to 10 carbon atoms, and m and n each represent an integer of 1 to 20;

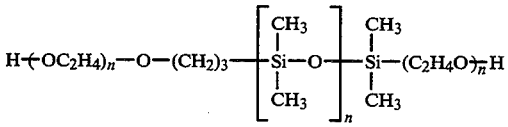

(X)

wherein n represents an integer of 0 to 300;

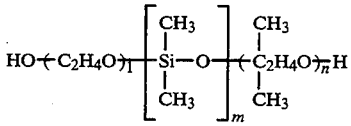

(XI)

wherein l represents an integer of 1 to 20, m represents an integer of 5 to 300, and n represents an integer of 1 to 10; and

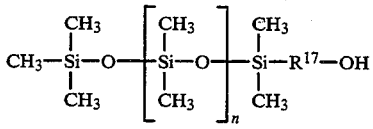

(XII)

wherein $R^{17}$ represents an alkylene group having 1 to 10 carbon atoms, and n represents an integer of 1 to 300.

27. The thermal image transfer recording medium as claimed in claim 1, wherein said polyisocyanate is selected from the group consisting of an aliphatic polyisocyanate compound having at least two isocyanate groups and an aromatic polyisocyanate compound having at least two isocyanate groups.

28. The thermal image transfer recording medium as claimed in claim 27, wherein said aliphatic polyisocyanate compound is 4-methoxy-2,4-diisocyanate.

29. The thermal image transfer recording medium as claimed in claim 27, wherein said aromatic polyisocyanate compound is selected from the group consisting of toluene-2,4-diisocyanate, toluene-2,6-diisocyanate, 4-isopropyl-1,3-phenylene-diisocyanate, 4-chloro-1,3-phenylenediisocyanate, 4-butoxy-1,3-phenylenediisocyanate, 2,4-diisocyanatediphenylether, 4,4-methylenebis(phenylisocyanate), 1,5-naphthalene diisocyanate, benzidine isocyanate, o-nitrobenzidine diisocyanate, 4,4-diisocyanate benzyl, m-phenylene diisocyanate, p-phenylene diisocyanate, 1,3-xylene diisocyanate, and 1,4-xylene diisocyanate.

30. The thermal image transfer recording medium as claimed in claim 1, wherein said heat-resistant protective layer has a thickness of 0.1 to 3.0 μm.

31. The thermal image transfer recording medium as claimed in claim 1, further comprising an overcoat layer provided on said thermal image transfer ink layer.

* * * * *

UNITED STATES PATENT AND TRADEMARK OFFICE

CERTIFICATE OF CORRECTION

PATENT NO. :5,352,527

DATED :October 4, 1994

INVENTOR(S) :Harada, et al.

It is certified that error appears in the above-identified patent and that said Letters Patent is hereby corrected as shown below:

Column 1, line 20, "Am" should read --As--.

Column 1, line 50, "60-201989." should read --60-201989,--.

Column 2, line 5, "has a excellent" delete --a--.

Column 2, line 33, "proposed, bun" should read --proposed, but--.

Column 3, line 5, "back side the" should read --back side of the--.

Column 4, line 53, "invention are am" should read --invention are as follows--.

UNITED STATES PATENT AND TRADEMARK OFFICE

CERTIFICATE OF CORRECTION

PATENT NO. : 5,352,527

DATED : October 4, 1994

INVENTOR(S) : Harada, et al.

It is certified that error appears in the above-identified patent and that said Letters Patent is hereby corrected as shown below:

Column 10, line 32, "carried cut" should read --carried out--.

Column 14, line 62, "nitrogen an" should read --nitrogen at--.

Column 15, line 26, "on support" should read --on the support--.

Column 15, line 46, "10 pares" should read --10 parts--.

Column 16, line 17, "a thickens" should read --a thickness--.

Column 16, line 29, "Comparative Example 3" should read --Comparative Example 2--.

UNITED STATES PATENT AND TRADEMARK OFFICE

CERTIFICATE OF CORRECTION

PATENT NO. : 5,352,527

DATED : October 4, 1994

INVENTOR(S) : Harada, et al.

It is certified that error appears in the above-identified patent and that said Letters Patent is hereby corrected as shown below:

Column 16, line 40, "layer a" should read --layer with a--.

Column 17, line 5, "Hoar-resistant" should read --Heat-resistant--.

Column 17, line 66, "4 pares" should read --4 parts--.

Column 19, line 61, "Meat-resistant" should read --Heat-resistant--.

Column 20, line 4, "further starred" should read --further stirred--.

Column 20, line 17, "am a" should read --as a--.

Column 21, line 26, "105°0" should read --105°--.

UNITED STATES PATENT AND TRADEMARK OFFICE

CERTIFICATE OF CORRECTION

PATENT NO. : 5,352,527

DATED : October 4, 1994

INVENTOR(S) : Harada, et al.

It is certified that error appears in the above-identified patent and that said Letters Patent is hereby corrected as shown below:

Column 21, line 43, "ketone no" should read --ketone to--.

Column 22, line 7, "on other" should read --on the other--.

Column 24, line 40, "Meat-resistant" should read --Heat-resistant-.

Column 26, line 27, "on other" should read --on the other--.

Column 26, line 68, "to 6," should read --to 16,--.

Column 27, line 12, "duet," should read --dust--.

Column 31, line 11, "phenyleneaiisocyanate,"
should read --phenylenediisocyanate--.

Signed and Sealed this

Fifth Day of December, 1995

*Attest:*

*Attesting Officer*

Bruce Lehman

BRUCE LEHMAN

*Commissioner of Patents and Trademarks*